United States Patent [19]

McKillop, Sr.

[11] 4,142,679

[45] Mar. 6, 1979

[54] BUILDING HEATING SYSTEM

[76] Inventor: Donald C. McKillop, Sr., 343 6th St., Canistota, S. Dak. 57012

[21] Appl. No.: 811,076

[22] Filed: Jun. 29, 1977

[51] Int. Cl.[2] ..... F24D 5/04

[52] U.S. Cl. ..... 237/54; 126/99C; 165/39; 165/2; 237/55

[58] Field of Search ..... 126/112, 117, 109, 99 A, 126/99 C; 165/50, 54, 154, 155, 156, 179, DIG. 2, 96, 39, 122, 2, 80; 237/54, 55, 53; 98/45, 46

[56] References Cited

U.S. PATENT DOCUMENTS 2,479,413 8/1949 Ryan ..... 165/DIG. 2

*Primary Examiner*—Richard E. Moore

*Attorney, Agent, or Firm*—Zarley, McKee, Thomte, Voorhees & Sease

[57] ABSTRACT

A heat jacket and flue assembly includes an air inlet in the attic for communication with humid outside air and an outlet adjacent the furnace in communication with the area to be heated. A fan moves air from the outside through the attic into the heat jacket and flue assembly where it is heated by the smoke being exhausted through the flue pipe and then it is distributed to the area to be heated directly or through the furnace.

10 Claims, 6 Drawing Figures

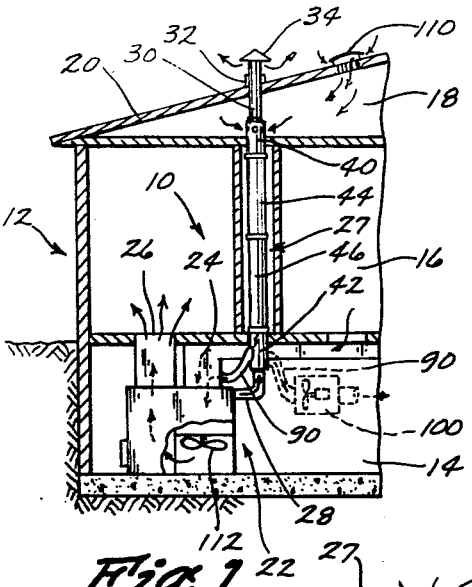
Fig. 1
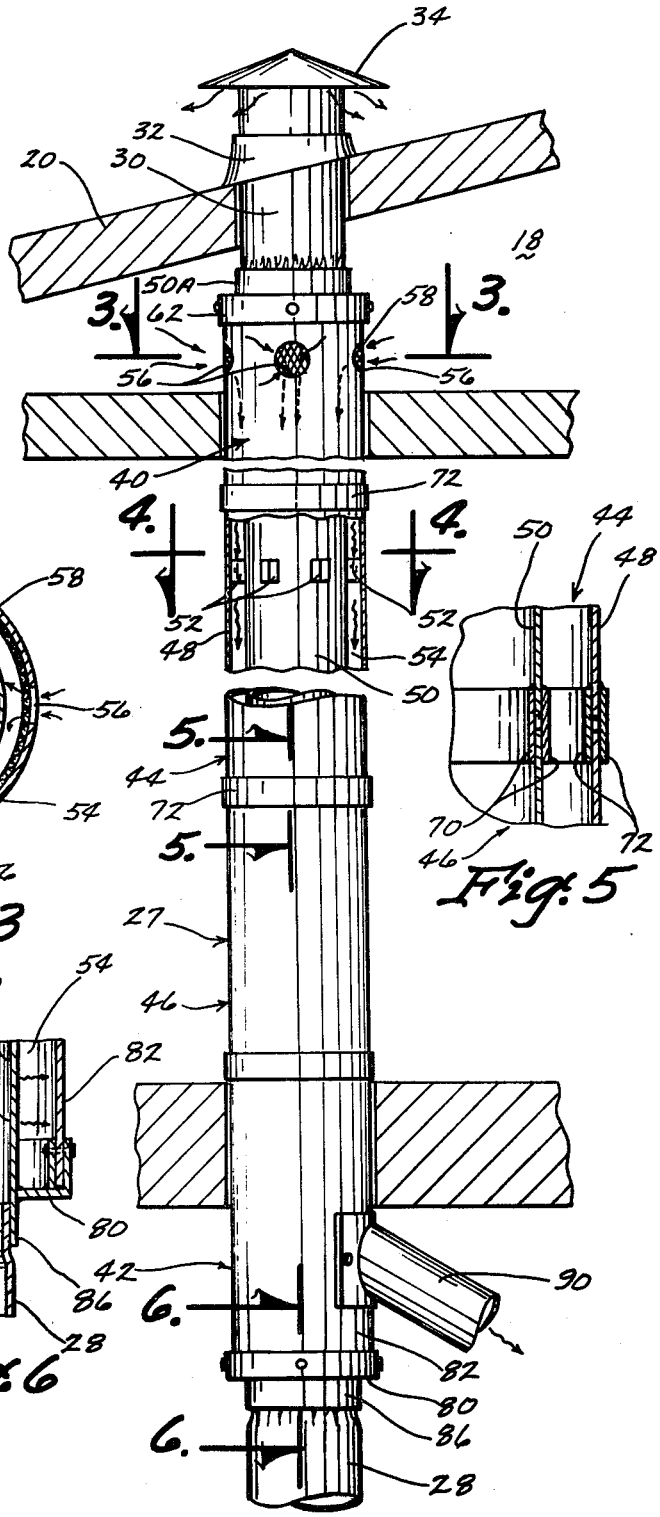
Fig. 2
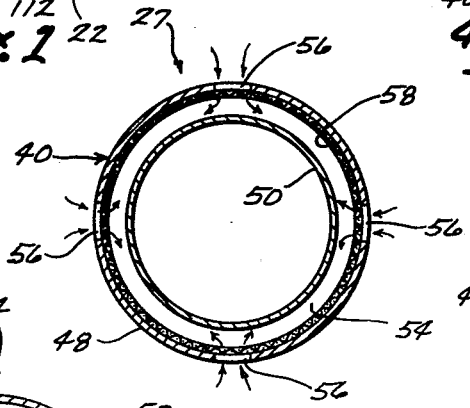
Fig. 3
Fig. 5
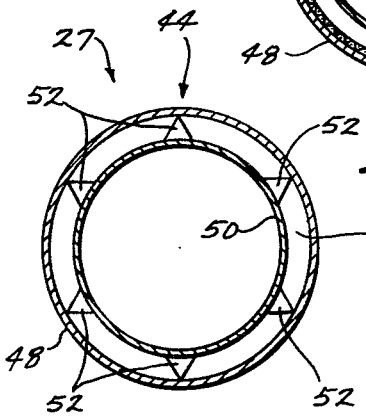
Fig. 4
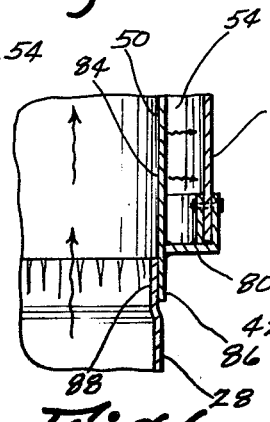
Fig. 6

BUILDING HEATING SYSTEM

BACKGROUND OF THE INVENTION

This invention relates to a heat jacket being placed on the chimney flue and passing air through the passageway provided therebetween for redistribution to areas bein heated. More specifically, however, this invention is concerned with providing to the areas to be heated air drawn in from the outside which is fresh and humid which is heated by the heat given off from the furnace flue pipe extending from the furnace to the top of the building. Utilization of heat produced by a flue pipe is disclosed in patents such as U.S. Pat. Nos. 2,890,866 and 3,124,197, however, these patents teach reheating used air rather than drawing in fresh humid air and heating it for distribution to the areas to be heated.

SUMMARY OF THE INVENTION

In accordance with the present invention a heat jacket and flue pipe assembly is provided which may be adapted to existing heating systems and will extend between the flue pipe connected to the furnace and the flue pipe extending from the attic through the roof for exhausting furnace smoke. Standard top and bottom assembly sections are interconnected by sections having various lengths adapted to the particular building. Each section includes the inner flue pipe and an outer heat jacket between which is a passageway through which air is drawn by a fan. The air moving through the passageway enters the assembly at the top in the attic and exits at the bottom adjacent the furnace and is fed directly to the area to be heated or is fed into the cold air return of the furnace and then redistributed to the areas being heated in a conventional manner. This system provides for fresh humid air warmed from heat which would otherwise be wasted.

DESCRIPTION OF THE DRAWINGS

FIG. 1 is a fragmentary cross-sectional view of a building utilizing the heating system of this invention.

FIG. 2 is an enlarged in scale fragmentary cross-sectional view of the heat jacket and flue pipe assembly.

FIG. 3 is a cross-sectional view taken along line 3 — 3 in FIG. 2.

FIG. 4 is a cross-sectional view taken along line 4 — 4 in FIG. 2.

FIG. 5 is a cross-sectional view taken along line 5 — 5 in FIG. 2.

FIG. 6 is a cross-sectional view taken along line 6 — 6 in FIG. 2.

DESCRIPTION OF THE PREFERRED EMBODIMENT

The building-heating system of this invention is referred to generally in FIG. 1 by the reference numeral 10 and is shown in a building such as a home 12 having a basement 14, living quarters 16, an attic 18 enclosed by a roof 20.

The heating system 10 includes a furnace 22 having a cold air return 24 and a hot air outlet 26. The furnace 22 is located in the basement 14 and exhausts smoke to the atmosphere through the heat jacket and flue pipe assembly 27 which is connected to a conventional lower flue pipe section 28 connected to the furnace 22. An upper flue pipe section 30 extends from the attic 18 through the roof 20. A storm collar 32 is fitted over the upper section 30 against the roof 20 and a chimney cap 34 is provided on the top to keep rain and the like out of the flue pipe.

The heat jacket and flue pipe assembly 27 is made up of a top section 40 and a bottom section 42 interconnected by intermediate sections 44 and 46 which may have varying lengths of two, three and five feet, making it possible to adapt the assembly 27 to any heating system. The top section 40 includes an outer jacket 48 surrounding an inner flue pipe 50 and spaced therefrom by circumferentially disposed spacers 52 positioned in a passageway 54. Inlet openings 56 are provided on the upper end in the attic 18 for transmitting air from the attic into the passageway 54. A screen 58 extends over the openings 56 to restrict admission into the passageway to air. The passageway 54 is closed at the upper end by an L-shaped annular member 62 riveted to the jacket 48 and welded to the flue pipe 50 which includes a portion 50A extending beyond the heat jacket 48. The lower end of the upper flue pipe section 30 is telescopically received in the upper end of the flue pipe 50.

The lower end of the top section 40 is received in the upper end of an intermediate section 44 which includes upwardly facing channels formed by two pairs of annular bands 70 and 72. The jacket pipe 50 and the flue pipe 48 extend down into these channels. The lower end of the intermediate sections 44 and 46 include a similar construction for engagement with the bottom heat jacket and flue pipe assembly section 42.

The bottom section 42 includes an L-shaped annular element 80 riveted to the jacket 82 and welded to the flue pipe 84. The flue pipe 84 extends beyond the jacket 82 and provides an annular portion 86 which telescopically receives the upper end 88 of the lower section flue pipe 28. An outlet pipe 90 extends from the jacket 82 for communication with the passageway 54 and is connected to the cold air return 24, as seen in FIG. 1, or optionally to a fan unit 100, as shown in the dash lines.

In operation it is seen that the building may be built utilizing the heating system of this invention or may be subsequently modified to include the heat jacket and flue assembly 27. Top and bottom assembly sections 40 and 42 are standard for the heat jacket and flue assembly and are interconnected by intermediate sections 40 and 46 having whatever length is desired for the given job. Fresh air from the outside is drawn in through a roof ventilator 110 into the attic 18 thence into the inlet openings 56 of the heat jacket and flue assembly 27 where the air is heated by the flue pipe and is then drawn downwardly into either the furnace 22 through the cold air return 24 or by the fan 100 whereupon it is redistributed for heating the building 12. The furnace 22 includes a fan 112 for moving the air in the heating system as well as drawing it through the heat jacket and flue assembly 27. Thus it is seen that fresh humid air is supplied to the area being heated rather than reheating the air that may have become stale and stagnant. Considerable energy is conserved by utilizing the heat wasted by the flue pipe in exhausting hot smoke to the atmosphere.

I claim:

1. A building heating system comprising, a building having a heated lower area and an upper attic area enclosed by a roof, and ventilating means in said attic to allow outside air to circulate through said attic, a heating unit in said lower area for heating said lower area, and including a smoke flue pipe extending from said heating unit upwardly through said attic and roof for communication with the atmosphere, and a heat jacket on said flue pipe forming a passageway therebetween extending from said attic substantially to said heating unit and having air inlet means at its upper end in said attic and outlet means at its lower end for discharge of heated outside air into said heated area.

2. The system of claim 1 wherein a fan means is in communication with said heat jacket for drawing air from the outside into said jacket in said attic and delivering it to said heated area.

3. The structure of claim 2 wherein said heat jacket outlet means is in communication with said heat unit.

4. The structure of claim 3 wherein said heat unit includes hot air outlet means and cold air return means and said heat jacket outlet means is in communication with said cold air outlet means.

5. The structure of claim 1 wherein said building includes a basement under said heated area and said heating unit is positioned in said basement and said heat jacket extends from said attic to said basement.

6. The structure of claim 1 wherein said heat jacket and flue pipe are further defined by said flue pipe having an upper section extending from said attic through said roof and a lower section extending from said heating unit, said heat jacket in combination with said flue pipe between said upper and lower sections forming a heat jacket and flue assembly having opposite ends detachably engaging said upper and lower flue sections.

7. The structure of claim 6 wherein said heat jacket and flue assembly includes top and bottom sections interconnected by at least one intermediate section, said top section having said air inlet means and said bottom section having said outlet means.

8. The structure of claim 7 wherein said jacket assembly includes circumferentially and longitudinally spaced apart spacers in said passageway between said flue pipe and said outer heat jacket.

9. The structure of claim 8 wherein said top and bottom heat jacket and flue assembly ends facing each other each include a pair of radially spaced apart annular channels which receive opposite ends of the heat jacket and flue pipe of said intermediate heat jacket and flue assembly section.

10. The structure of claim 9 wherein the top end of said top section and the bottom end of said bottom section of said heat jacket and flue assembly include cap means closing said passageway between said heat jacket and said flue pipe with said flue pipe extending outwardly and telescopically interconnecting with the adjacent ends of said upper and lower flue pipe sections.

* * * * *